United States Patent [19]

Jessen

[11] 4,329,929

[45] May 18, 1982

[54] WET DEASHER

[75] Inventor: Bruno Jessen, Hamburg, Fed. Rep. of Germany

[73] Assignee: Deutsche Babcock Aktiengesellschaft, Oberhausen, Fed. Rep. of Germany

[21] Appl. No.: 199,104

[22] Filed: Oct. 20, 1980

[30] Foreign Application Priority Data

Jan. 11, 1980 [DE] Fed. Rep. of Germany ..... 300791

[51] Int. Cl.[3] ..... F23J 1/02

[52] U.S. Cl. ..... 110/171; 110/165 R; 126/242

[58] Field of Search ..... 110/171, 165 R, 165 A; 126/242, 243

[56] References Cited

U.S. PATENT DOCUMENTS 2,409,567 10/1946 Hopping ..... 110/171
3,915,105 10/1975 Michelbrink ..... 110/171 X
4,213,402 7/1980 Kochey ..... 110/171

*Primary Examiner*—Edward G. Favors
*Attorney, Agent, or Firm*—Max Fogiel

[57] ABSTRACT

A wet deasher arrangement in which a trough is filled with quenched water and is arranged underneath an ash hopper of a boiler. The trough is provided with a quench water feed as well as an overflow and ash conveying equipment. The quench water is permanently circulated through a cooling unit with the aid of a pump, and the cooling unit is arranged between the overflow and the quench water feed. Oblique parallel plates are arranged within the trough before the overflow. The cooling unit has heat exchanger tubes divided into sections which are swept successively by quench water. They are accommodated in a pump upstream tank which precedes the pump. The upstream tank is obliquely arranged and converges to an outlet opening. The sections of the cooling unit may be arranged above each other within the pump upstream tank.

5 Claims, 4 Drawing Figures

WET DEASHER

BACKGROUND OF THE INVENTION

The present invention relates to a wet deasher consisting of a trough filled with quench water. The trough is arranged underneath the ash hopper of a boiler, and is provided with a quench water feed as well as overflow. The trough accommodates ash conveying equipment. Cooling equipment through which the quench water is permanently circulated by means of a pump, is arranged between the overflow and the quench water feed. One or several packs of oblique, parallel plates is/are arranged within the trough before the overflow, according to German Patent Application No. P 28 30 380.20.

One embodiment of this wet deasher has, as cooling equipment, a separate tubular heat exchanger through which the quench water is circulated. After having passed the separator plates the quench water contains only a certain quantity of finest solids having a grain size of minus 0.1 mm and a sinking velocity which is much slower than 1 mm/min.

The design of the cooling equipment must ensure that the flow velocity of the quench water is higher than the sinking velocity of the particles and is so high as to prevent also deposition.

Furthermore the particles sinking by inevitable turbulences shall be returned directly to the pump without remaining in the cooling equipment. The present invention pursues the object of subjecting a wet deasher according to German Patent Application No. P 28 30 380.2 to a further development, so that these requirements are met and, moreover, the physical design of the wet deasher plant is simplified.

Another object of the present invention is to provide an arrangement of the foregoing character which is substantially simple in construction and may be economically fabricated.

A further object of the present invention is to provide an arrangement which may be easily maintained in service and which has a substantially long operating life.

SUMMARY OF THE INVENTION

According to the present invention, these objects are achieved by dividing the heat exchanger tubes of the cooling equipment into sections which are successively swept by the quench water. The tubes are accommodated in a tank preceding the pump, and the bottom of the pump upstream tank is arranged obliquely towards an outlet opening.

Accommodating the heat exchanger tubes of the cooling equipment in the pump upstream tank, which is required in any event, allows a separate cooler to be eliminated, so that the plant will be simplified. In this case the walls of the pump upstream tank form the shell of the cooling equipment. In the pump upstream tank it is possible to maintain the velocities which are necessary for largely preventing the floating particles from settling.

For an advantageous further development of the invention, there is provided a horizontal nest of heat exchanger tubes with vertical baffles. A passage opening which, in comparison with the outlet opening, has a small cross-section may be left between the bottom of the pump upstream tank and the lower edge of the baffle adjacent to the outlet of the pump upstream tank. By the convergence of oblique bottom plates in the upstream tank and by the creation of a narrow passage opening in the area of the last baffle, the particular conditions are given for continuous withdrawal of the sinking particles by means of the pump.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
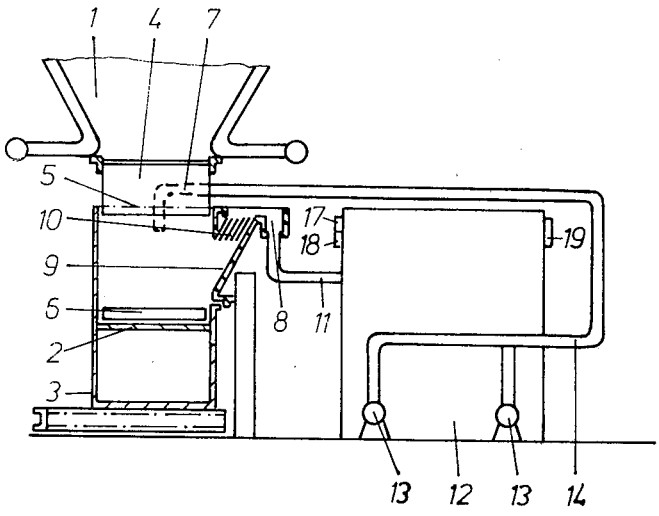
FIG. 1 shows a longitudinal section through a wet deasher, in accordance with the present invention.

The wet deasher is applied underneath the pulverized coal combustion chambers of steam boiler plants. From the hopper 1 of a boiler, the ash enters into a trough 3 which is filled with quench water above a closed intermediate bottom 2. The lower end of the ash hopper 1 immerses, with a dipping element 4, into the water level 5 within trough 3. In this manner, the ash hopper 1 is movably sealed against trough 3. Trough 3 is open at top and rises towards one side. Conveying equipment designed as a drag-link chain conveyor, runs in trough 3 for discharging the cooled ash. The drag-link chain conveyor consists of two chains between which flights 6 are attached at a distance towards each other. The ash falling into the wet deasher will be carried by the flights 6 in the upper strand of the drag-link conveyor to an ash outlet, and will be discharged there.

The quench water is supplied to the trough 3 through a quench water feed 7 which extends into trough 3. On one side trough 3 is provided with an overflow 8.

Before overflow 8, several packs of parallel plates 10 are juxtaposed within an obliquely rising channel section 9 of trough 3 in its longitudinal direction. The number of the packs depends upon the length of trough 3. The plates 10 are plain and may consist of plastics. They are maintained at a given distance by means of spacers. The inclination of the plates 10 towards the horizontal amounts to between approximately 50° and 60°. The plates extend almost over the entire length of trough 3. The quench water leaving the trough contains only small amounts of solids which, due to their small size, have a slow sinking velocity.

The quench water is kept in circulation and is cooled on its route. To this end, the overflow 8 communicates by lines 11 with a pump upstream tank 12 to which one or several pumps 13 is/are connected. The pumps 13 deliver the quench water through a piping system 14 back to the quench water feed 7. Fresh water is added as a make-up for quench water losses.

Figure 2:
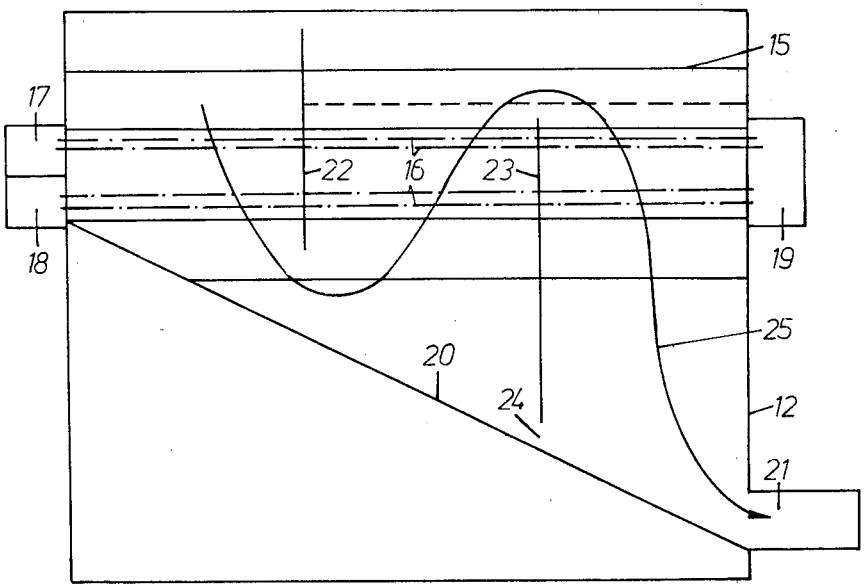
FIG. 2 shows a longitudinal section through a pump upstream tank.
Figure 3:
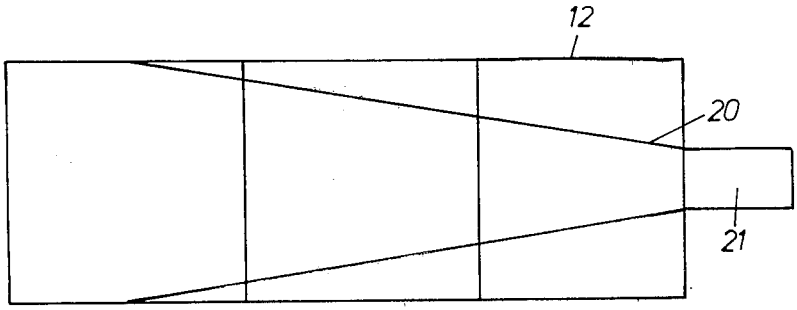
FIG. 3 is a plan view of FIG. 2.

FIG. 2 shows a horizontal nest of straight heat exchanger tubes 16 arranged in the top portion of the pump upstream tank 12, underneath the water level 15. The heat exchanger tubes 16 terminate in two collecting chambers 17 and 18, as well as in one return chamber 19 arranged outside of the pump upstream tank 12. The coolant is supplied to the upper collecting chamber 17 and is withdrawn from the lower collecting chamber 18. The coolant for indirectly cooling the quench water may be taken from water resources to which it may be returned afterwards.

The coolant may be in the form of corrosive sea water or slop water, e.g. from a canal.

The bottom of the pump upstream tank 12 consists of obliquely positioned bottom plates 20 converging to the outlet opening 21 which is arranged in the lower portion of the pump upstream tank 12.

Several baffles —in the present case two, namely 22 and 23—are mounted on the nest of the heat exchanger tubes 16 in staggered arrangement towards each other. These baffles 22 and 23 extend across the whole pump upstream tank 12 in vertical relationship to the heat exchanger tubes 16. Baffle 22 projects beyond the water level 15 in the pump upstream tank 12, and maintains a large distance from the bottom plate 20. Baffle 23 is situated underneath the lowest water level and is seated on the bottom plate 20, except for a small passage opening 24. In this way the nest is divided into several sections swept by the quench water in succession. The flow direction of the quench water drawn by pump 13 is shown by line 25.

The quench water flow velocity to be maintained in the pump upstream tank 12, is sufficient for preventing the solids from sinking. All solid particles still contained in the quench water will therefore be extracted from the pump upstream tank 12 with the quench water by means of pump 13. Settling of these particles will consequently be avoided. Particles which, by reason of inevitable turbulences, sink to the bottom plate 20 in spite of all, will be supplied through the passage opening 24 directly to the outlet opening 21. The cross-section of the passage opening 24 is much smaller than the cross-section of the outlet opening 21. This is the reason why only small quantities of quench water will be removed from the pump upstream tank 12 without being recooled again.

Figure 4:
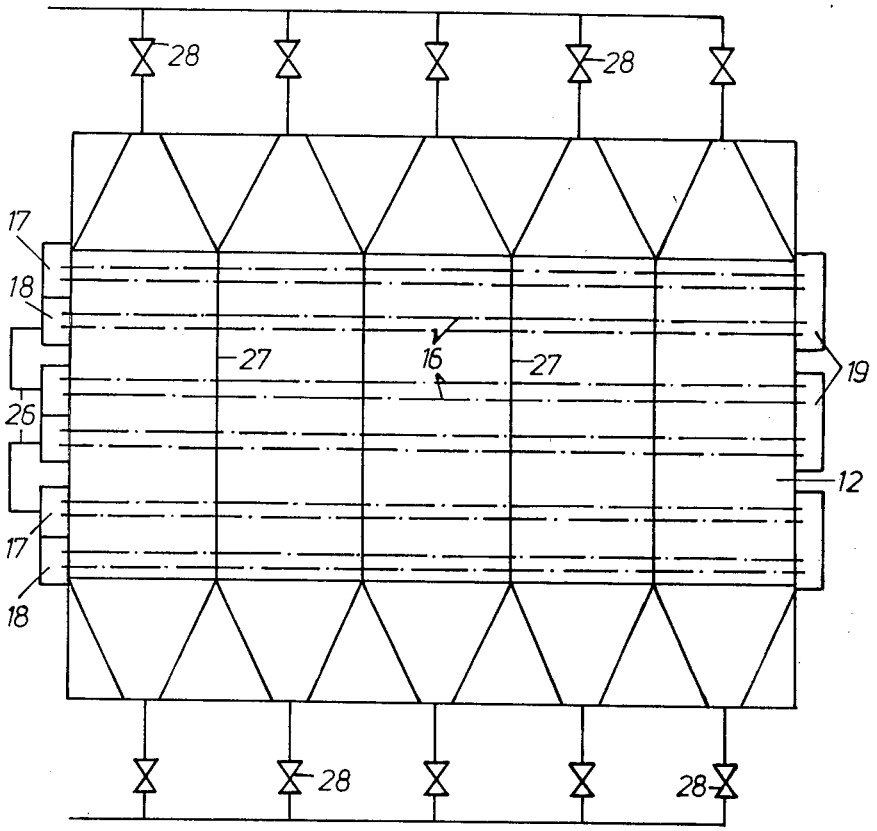
FIG. 4 shows a longitudinal section through a pump upstream tank according to another embodiment of the present invention.

FIG. 4 shows an embodiment in which several nests of straight heat exchanger tubes 16 are arranged above each other. By one rerouting line 26 each lower collecting chamber 18 is connected with the upper collecting chamber 17 of the nest arranged below. Vertical partition walls 27 divide the pump upstream tank 12 into several sections. Quench water is supplied to the individual sections and is withdrawn from them through adjustable shutoff elements 28. It is also possible to shut down individual sections completely. Otherwise the basic design of the pump upstream tank shown in FIG. 4 corresponds to that represented in FIG. 2.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A wet deasher comprising: a trough filled with quench water and arranged underneath an ash hopper of a boiler; said trough having a quench water feed and overflow means; ash conveying means in said trough; cooling means arranged between said overflow means and said quench water feed; pump means for circulating quench water permanently through said cooling means; at least one pack of oblique parallel plates arranged within said trough before the overflow; said cooling means having heat exchanger tubes divided into sections swept successively by the quench water; a pump upstream tank preceding said pump means for receiving said heat exchanger tubes; said pump upstream tank having a bottom obliquely arranged and converging to an outlet opening.

2. Wet deasher according to claim 1, wherein said sections are arranged above each other within said pump upstream tank.

3. Wet deasher according to claim 1, wherein said heat exchanger tubes comprise a nest of horizontal tubes having vertical baffles.

4. Wet deasher according to claim 3, including a passage opening between the bottom of said pump upstream tank and the lower edge of a baffle adjacent to said outlet opening of said pump upstream tank; said passage opening having a cross-section which is substantially small relative to the cross-section of said outlet opening.

5. Wet deasher according to claim 1, including collecting chamber means and return chamber means located outside of said pump upstream tank; said heat exchanger tubes terminating in said collecting chamber means and said return chamber means.

* * * * *

UNITED STATES PATENT AND TRADEMARK OFFICE

CERTIFICATE OF CORRECTION

PATENT NO. : 4,329,929

DATED : May 18, 1982

INVENTOR(S) : BRUNO JESSEN

It is certified that error appears in the above-identified patent and that said Letters Patent are hereby corrected as shown below:

Front page, left column, item "[30] Foreign Application Priority Data," second line:

change "300791" to --3000791--

Signed and Sealed this

*Fifteenth* Day of *November 1983*

[SEAL]

*Attest:*

GERALD J. MOSSINGHOFF

*Attesting Officer*

*Commissioner of Patents and Trademarks*